United States Patent [19]

Tamura

[11] Patent Number: 4,516,764

[45] Date of Patent: May 14, 1985

[54] PAPER FEEDING DEVICE

[75] Inventor: Takashi Tamura, Hachioji, Japan

[73] Assignee: Konishiroku Photo Industry Co., Ltd., Tokyo, Japan

[21] Appl. No.: 442,510

[22] Filed: Nov. 18, 1982

[30] Foreign Application Priority Data

Nov. 30, 1981 [JP] Japan ..... 56-192300

[51] Int. Cl.[3] ..... B65H 3/04

[52] U.S. Cl. ..... 271/34; 271/9; 271/114; 271/127; 271/162

[58] Field of Search ..... 271/34, 114, 115, 116, 271/126, 127, 9, 162

[56] References Cited

U.S. PATENT DOCUMENTS 4,060,233 11/1977 Stange ..... 271/127 X
4,097,041 6/1978 Fujimoto ..... 271/114
4,346,878 8/1982 Aizawa ..... 271/127 X
4,422,631 12/1983 Sugizaki ..... 271/127 X

*Primary Examiner*—Richard A. Schacher
*Attorney, Agent, or Firm*—Jordan B. Bierman

[57] ABSTRACT

A paper feeding device comprises a paper feeding member feeding out paper from a cassette on a stand, and a lifting member for lifting the paper loaded on a bottom plate of the cassette against the paper feeding member. The improvement includes a driving system having a first spring clutch and a locking member deterring the spring clutch which is operated by a paper feeding command, a lift-operating member coupled with the locking member and including a second spring clutch engaged with the driving system, and an energizing member connected between the lift-operating member and the lifting member for providing a lifting force to the lifting member only during operation of the lift-operating member during paper feeding.

1 Claim, 4 Drawing Figures

PAPER FEEDING DEVICE

BACKGROUND OF THE INVENTION

The present invention relates to a paper feeding device to be used in a recording apparatus such as an electrophotographic copier or the like and particularly to a paper feeding device wherein a paper is fed with a bottom plate in the paper feeding cassette on which recording papers (sheet paper) are loaded, and which is lifted up each time a paper is fed.

As is well known, in many of the paper feeding devices for electrophotographic copying machines or the like, papers are loaded on the bottom plate in the paper feeding cassette, the bottom plate is lifted to a paper feeding member such as a paper feeding roller, and the paper feeding is performed by function of the paper feeding member.

In a paper feeding device of this type, it is necessary to release a member for lifting the bottom plate from the paper feeding cassette when the paper feeding cassette is inserted or extracted from a paper feeding stand. In the past, therefore, a manually-operated lever that can control the posture of the lifting member has been provided with the paper feeding stand and the manual operation of said lever release the lifting member from the paper feeding cassette. Alternatively, a cam that controls the posture of the lifting member has been provided on one side of the paper feeding cassette and thereby the lifting member is pulled in temporarily inside of the paper feeding stand from the inside of the cassette when the paper feeding cassette is inserted or extracted. With the former structure, however, extremely troublesome operations are needed because the manually-operated lever must be operated each time the paper feeding cassette is inserted or extracted. With the latter structure, on the other hand, there has been a problem that an insertion or an extraction of the paper feeding cassette is not easy because a considerable resistance is applied on the paper feeding cassette when it is inserted or extracted.

Therefore, previously, the inventor of the present invention proposed a paper feeding device with a structure wherein the bottom plate of the paper feeding cassette is lifted only when the paper feeding operation is made, in U.S. patent application Ser. No. 386,624 (filed on June 9, 1982). Namely, in the paper feeding device, the lifting member energized by a spring is locked in a non-operation position by a deterring member, and the escape of the deterring member and the rotation start of the paper feeding member (a paper feeding roller) are made by a clutch such as an electromagnetic clutch or the like incorporated in the power system. However, the above paper feeding device, though it has a merit that the insertion and the extraction of the paper feeding cassette can be made smoothly without any manual operation, has drawbacks that the spring to energize the lifting member tends to become fatigued since it is always kept in the loaded condition and an expensive electromagnetic clutch or the like is needed.

SUMMARY OF THE INVENTION

It is an object of the present invention to offer a paper feeding device wherein the insertion and the extraction of the paper feeding cassette can be made smoothly without any manual operation, the life thereof is long and it can be manufactured inexpensively.

The present invention attains the above object by a paper feeding device comprising a locking member that always deters a spring clutch that is operated by a paper feeding command operator and incorporated in the driving system on the paper feeding stand, an energizing member that gives a lifting force to a lifting member and a lift-controlling member, that makes a lift-operating member coupled with said locking member. The lift-controlling member operates said energizing member when said paper feeding command operator is in a non-operation position and keeps the lift-operating member in an operation position during the period of operation of the paper feeding command operator. The paper feeding device includes a draw-out member that takes out the recording paper from a paper feeding cassette set on the paper feeding stand and a lifting member that lifts the bottom plate of the paper feeding cassette against the draw-out member only when the paper is fed.

DETAILED DESCRIPTION OF THE PREFERRED EMBODIMENT

Figure 1:
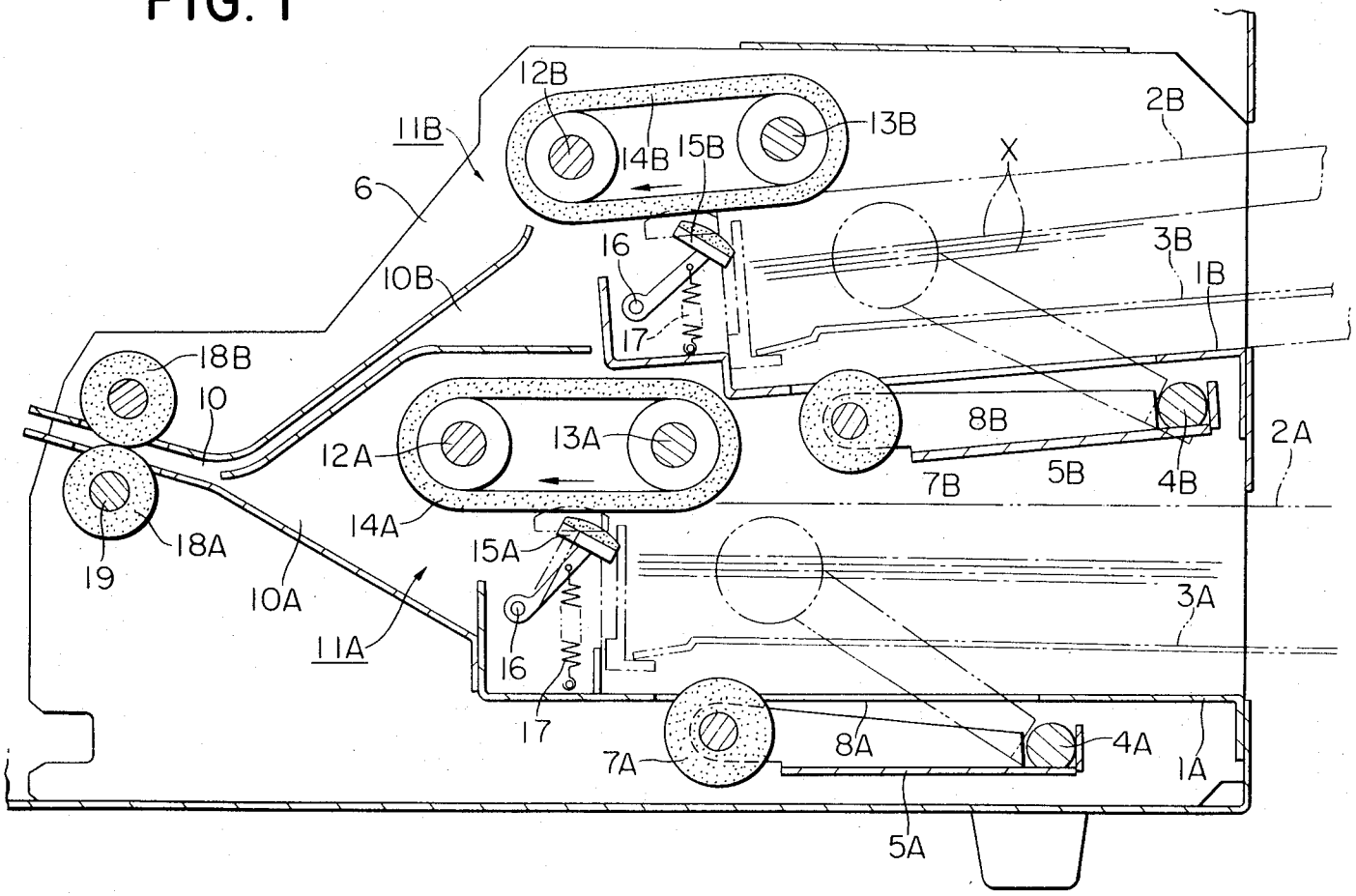
FIG. 1 is a sectional view of a paper feeding device of the present invention.

FIG. 1 is a sectional view of a paper feeding device of the present invention applied in an electrophotographic copying machine. The paper feeding device is provided with two sets of paper feeding stands 1A and 1B in which paper feeding cassettes 2A and 2B containing recording papers X can be set respectively. These paper feeding cassettes 2A and 2B have the bottom plates 3A and 3B on which recording papers X are loaded in a stack respectively, and these bottom plates 3A and 3B are lifted up by lifting members 5A and 5B attached to lifting shafts 4A and 4B located on the bottom of the paper feeding stands 1A and 1B respectively. Namely, these lifting shafts 4A and 4B are supported by a side frame 6, and edge portion rollers 7A and 7B of said lifting members 5A and 5B can advance into the inside of the paper feeding cassettes 2A and 2B through openings 8A and 8B in paper feeding stands 1A and 1B respectively. Incidentally, driven levers 9A and 9B shown in FIG. 2 are fixed on the ends of lifting shafts 4A and 4B, respectively and said lifting members 5A and 5B are lifted up through said driven levers 9A and 9B.

In FIG. 1, at the upper part of the inside of paper feeding stands 1A and 1B, there are positioned paper feeding units 11A and 11B that feed out recording papers X in the paper feeding cassettes 2A and 2B one sheet at a time to paper feeding paths 10A and 10B. These paper feeding units 11A and 11B consist essentially of parallel belt driving shafts 12A and 12B, and belt driven shafts 13A and 13B supported in side frames 6, respectively. Paper feeding belts 14A and 14B are trained over said belt driving shafts and driven shafts, and separating members for preventing paper double feeding 15A and 15B are moved in pressure contact with the surface of said paper feeding belts 14A and 14B. The separating members 15A and 15B, supported on shafts 16, 16, are depressed at the front of the paper feeding cassettes 2A and 2B and brought into pressure contact with the surface of paper feeding belts 14A and 14B, and are energized by the spring 17 in the direction to separate from the paper feeding belts 14A and 14B. Therefore, when the paper feeding cassettes 2A and 2B are taken out from the paper feeding stands 1A and 1B, the recording papers X sandwiched between the paper feeding belts 14A and 14B and the separating members 15A and 15B can be taken out with the paper feeding cassettes 2A and 2B.

At the joining point 10 of the paper feeding paths 10A and 10B, a pair of paper registration rollers 18A and 18B are located and a driving shaft 19 of the paper feeding roller 18A transmits to a driving force.

Figure 2:
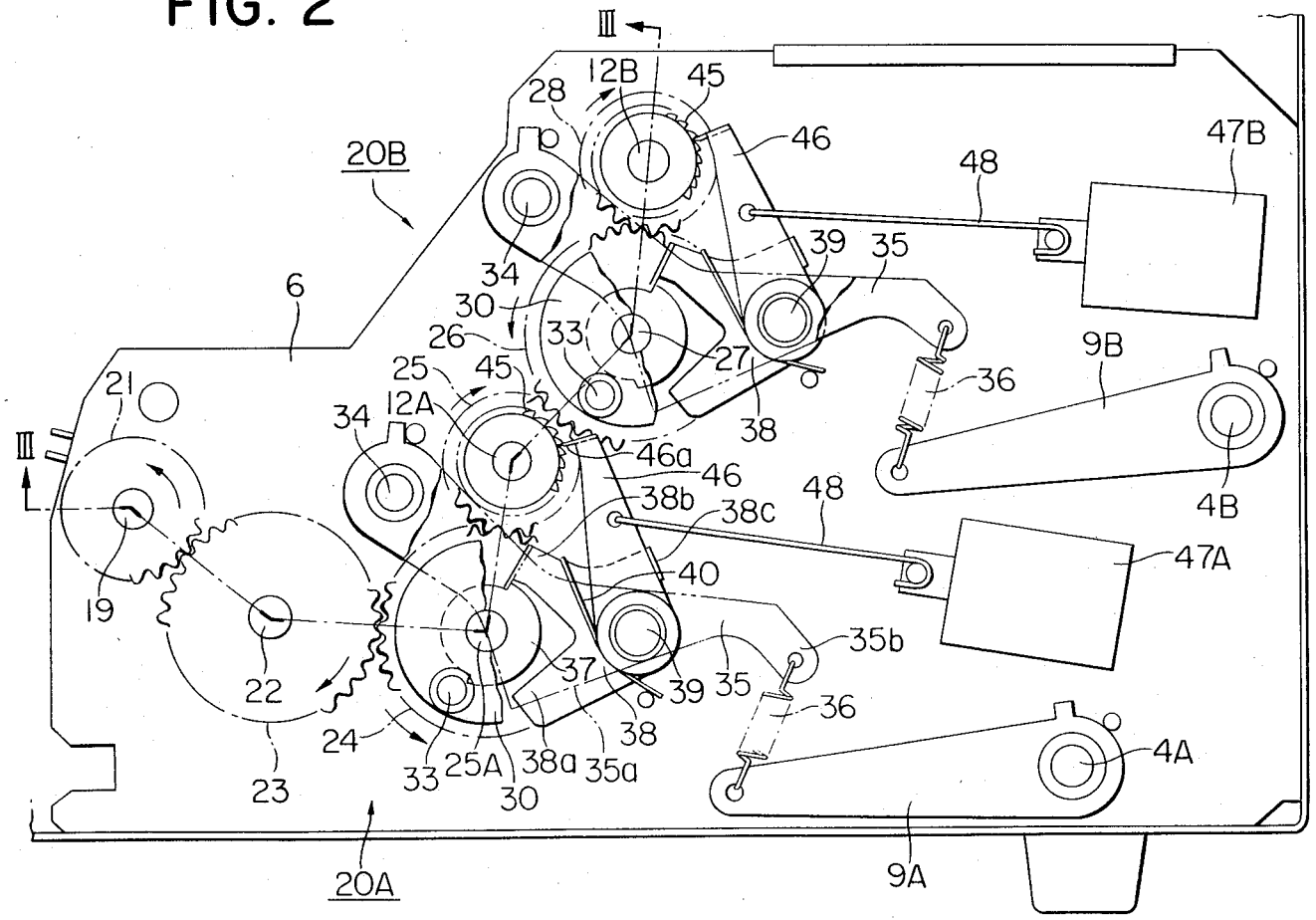
FIG. 2 is a side view of said paper feeding device.
Figure 3:
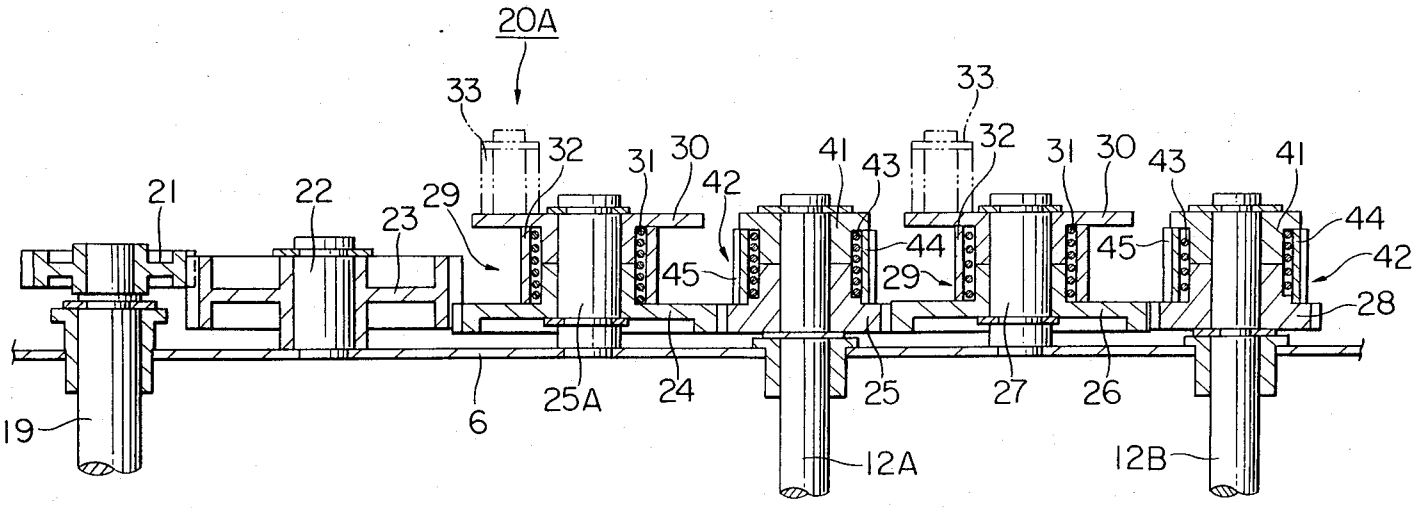
FIG. 3 is a sectional view taken on line III—III of FIG. 2.

FIG. 2 and FIG. 3 show a controlling means that controls the driven levers 9A and 9B, the belt driving shafts 12A and 12B and that paper registration roller 18A. The controlling means is equipped with a first controlling unit 20A that controls the belt driving shaft 12A and the driven lever 9A, and a second controlling unit 20B that controls the belt driving shaft 12B and the driven lever 9B. Further, the controlling means includes a driving gear 21 that is fixed to the driving shaft 19 of above paper registration roller 18A and is rotated in the direction of an arrow. The driving gear 21 roatates a first input gear 24 of the first controlling unit 20A through an intermediate gear 23 supported rotatably on an intermediate shaft 22 fixed in the side frames 6, 6. The first input gear 24 is fixed rotatably on a first supporting shaft 25A supported between the side frames 6, 6, and is engaged with a belt driving gear 25 fitted loosely around the end of said belt driving shaft 12A, The belt driving gear 25 rotates a second input gear 26 of the second controlling unit 20B. Similarly to the first input gear 24, this second input gear 26 is fitted rotatably around a second supporting shaft 27 supported between the side frames 6, 6, and is engaged with the belt driving gear 28 loosely fitted around the end of said belt driving shaft 12B.

The constitution of the first controlling unit 20A and that of the second controlling unit 20B, other than the aforesaid structure, are the same and both of them are represented by the explanation of the first controlling unit 20A. A spring clutch 29 is assembled on the first supporting shaft 25A thereof. This spring clutch 29 is formed with a spring 31 wound round a hub of the first input gear 24 and a hub of a rotating disk 30 fitted loosely round the first supporting shaft, and a sleeve 32 covering the external surface of the spring 31. On the surface of the rotating disk 31, an operation pin 33 is mounted and, within the movement range of said operation pin 33, a middle portion **35*a* of a lift-operating member 35 is located such that its base is supported on the shaft 34 in side frames 6, 6. Between the tip portion 35*b* of the lift-operating lever 35 and the tip portion of the driven lever 9A, an energizing member such as the energizing spring 36 is hung. On the circumferential surface of the sleeve 32 of the spring clutch 29, a protruding circumferential cam 37 is provided over about a semicircular arc and in the same plane with said circumferential cam 37, a lift-controlling member, for instance a lift-controlling claw 38, is located. The lift-controlling claw 38 is formed in a V-shape whose bend portion is supported round the shaft 39 supported between side frames 6, 6. It is energized by the spring 40 in the counterclockwise direction in FIG. 2. A pair of engaging tip portion 38*a* and 38*b* of the lift-controlling claw 38 engage selectively with the circumferential cam 37 and controls the spring clutch 29**.

On the end of the belt driving shaft 12A, a shaft end member 41 facing to said belt driving gear 25 is fixed and a spring clutch 42 is also attached. The spring clutch 42 comprises a spring 43 wound round the hub of the belt driving gear 25 and the hub of the shaft end member 41, and a sleeve 44 covering the external surface of the spring 43. On the external surface of the sleeve 44, circumferential teeth 45 are formed and on said circumferential teeth 45, the tip portion **46*a* of the locking member whose base portion is supported round the shaft 39 or of the locking lever 46 is located. At the middle portion of the lift-controlling claw 38, the dog portion 38C is formed and the contact of the dog portion 38C against the side of the locking lever 46 causes the lift-controlling claw 38 to be coupled with the movement of the locking lever 46. Further, on the surface of aforesaid side frame 6, paper feeding command operators are provided for each controlling unit and to each of which a paper feeding command signal is inputted from the main body of the electrophotographic copying machine, namely, magnetic solenoids 47A and 47B are arrranged. These magnetic solenoids 47A and 47B control the locking levers 46 of the first controlling unit 20A or the second controlling unit 20B through the rods 48**.

Since the device of above example has the structure mentioned above, when the paper feeding cassette 2A or 2B is not inserted in the paper feeding stand 1A or 1B, the separating members 15A and 15B are separted from paper feeding belts 14A and 14B respectively as shown in FIG. 1 and each member in the paper feeding device takes the position shown in FIG. 2. If the paper feeding cassettes 2A and 2B are inserted into the paper feeding stand 1A and 1B respectively under such state, the separating members 15A and 15B are moved into pressure contact with the surface of paper feeding belts 14A and 14B respectively, as shown by the imaginary line in FIG. 1. Now, if the copy button (unillustrated) is pushed, the gears are rotated in the directions shown with arrows in FIG. 2. If the paper feeding command signal is inputted to the magnetic solenoid 47A or 47B concurrently, the rod 48 is pulled toward right side, the locking lever 46 is rotated around the shaft 39 clockwise, the tip portion **46*a* of the locking lever 46 comes off the circumferential teeth 45 of the spring clutch 42 and thus the restriction for the sleeve 44 is removed. Therefore, the driving force transmitted to the belt driving gear 25 is transmitted to the belt driving shaft 12A or 12B through the spring clutch 42 and thus paper feeding belt 14A or 14B** starts rotating.

Figure 4:
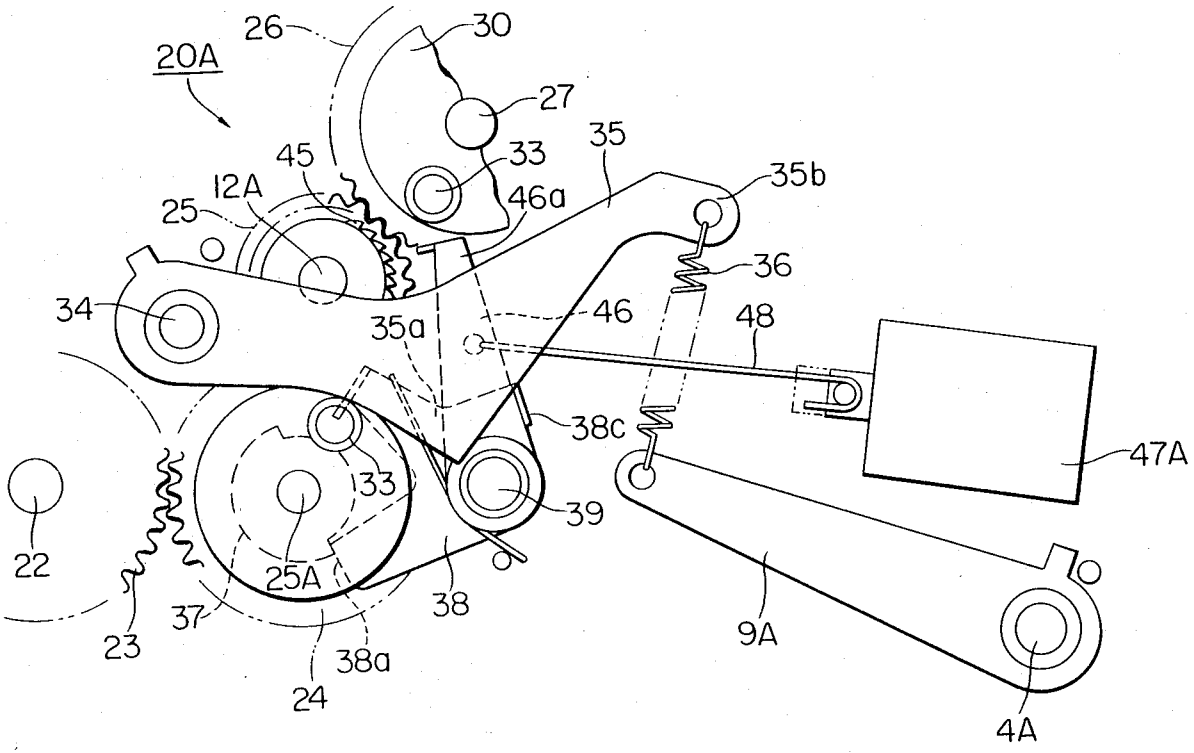
FIG. 4 is an operation illustrating diagram in the lifting state of the paper feeding device.

Concurrently with this, the lift-controlling claw 38 also swivels around the shaft 39 clockwise by the rotation of the locking lever 46, the engaging end portion **38*b* of the lift-controlling claw 38 comes off the circumferential cam 37, and the engaging end portion 38*a* of said claw enters the movement range of the circumferential cam 37. Consequently, the rotating motion of the input gear 24 or 26 is transmitted to the rotating disk 30 through the spring clutch 29, the lift-operating lever 35 is lifted by the operation pin 3 as shown in FIG. 4, the engaging end portion 38*a* of the lift-controlling claw 38 engages with the front end of the circumferential cam 37 and the lift-operating lever 35 is kept at the operation position. Therefore, since the driven lever 9A or 9B is rotated clockwise by the lift-operating lever 35 through the energizing spring 36, the lifting member 5A or 5B** lifts the bottom plate 3A or 3B of the paper feeding cassette 2A or 2B and thus the recording papers X are fed out one sheet at a time by the paper feeding unit 11A or 11B.

When there is no input of the paper feeding command signal, the belt driving shafts 12A and 12B are immediately stopped because the locking lever 46 engages again with circumferential teeth 45. Since the engaging end portion 38*a* of the lift-controlling claw 38 escapes from the circumferential cam 37, the rotating disk 30 is rotated again and the lift-operating lever 35 returns to the non-operation position shown in FIG. 2 The lifting member 5A or 5B will be in the state that it is moved under the paper feeding stand 1A or 1B, and thus it can slip out of the paper feeding cassette 2A or 2B freely. Incidentally, if the lift-operation lever 35 returns to the non-operation position, the engaging end portion 38*b* of the lift-controlling claw 38 hits the front end portion of the circumferential cam 37 and thereby the spring clutch 29 slips and the rotating disk is stopped.

As is clear from the aforesaid explanation, it is possible, through the present invention, to obtain a paper feeding device wherein the energizing spring does not become fatigued, unlike the condition in the past, because the lifting member is energized only when the paper is fed. The paper feeding cassette can freely be inserted or extracted without any resistance. Further, this paper feeding device can be manufactured relatively inexpensively because it does not employ any expensive parts such as an electromagnetic clutch or the like.

What is claimed is:

1. In a paper feeding device comprising a paper feeding member for feeding out paper from a cassette inserted on a stand, a driving system for driving the paper feeding member upon a paper feeding command, and a lifting member for lifting papers loaded on a bottom plate of the cassette against the paper feeding member during a paper feeding operation, the improvement comprising a first spring clutch and a locking member deterring said first spring clutch which are incorporated in said driving system for driving the paper feeding member upon a paper feeding command, a lift-operating member coupled with said locking member for operating said lifting meber upon said paper feeding command, an energizing member connected between said lift-operating member and said lifting member for applying a lifting force to said lifting member only upon activation of said lift-operating member, and a second spring clutch engaged with said driving system for applying rotational movement to said lift-operating member when said driving system is operated upon a paper feeding command, said lift-operating member being moved to a non-operating position and said energizing member being deenergized during the period when a paper feeding command is not in effect.

* * * * *